US005806215A

United States Patent [19]

Matthews

[11] Patent Number: 5,806,215

[45] Date of Patent: Sep. 15, 1998

[54] EXCAVATOR TOOTH RETAINING ASSEMBLY

[75] Inventor: Neville Eugene Matthews, Logan City, Australia

[73] Assignee: Carol Thelma Matthews, Logan City, Australia

[21] Appl. No.: 244,611

[22] PCT Filed: Apr. 7, 1993

[86] PCT No.: PCT/AU93/00152

§ 371 Date: Jun. 3, 1994

§ 102(e) Date: Jun. 3, 1994

[87] PCT Pub. No.: WO93/20293

PCT Pub. Date: Oct. 14, 1993

[30] Foreign Application Priority Data

Apr. 7, 1992 [AU] Australia ..... pl 1760
Sep. 11, 1992 [AU] Australia ..... pl 4680

[51] Int. Cl.[6] ..... E02F 9/28

[52] U.S. Cl. ..... 37/452; 37/456; 37/458

[58] Field of Search ..... 37/450, 452, 453, 37/454, 455, 456, 457, 458; 172/772, 772.5

[56] References Cited

U.S. PATENT DOCUMENTS

| | | | |
|---|---|---|---|
| 3,175,314 | 3/1965 | Williamson | 37/458 |
| 3,256,622 | 6/1966 | Hostetter | 37/458 |
| 3,341,253 | 9/1967 | Hostetter | 37/458 |
| 3,664,044 | 5/1972 | Hahn | 37/456 |
| 3,894,349 | 7/1975 | Moreau | 37/457 |
| 4,077,729 | 3/1978 | Schwappach | 37/457 X |
| 4,192,089 | 3/1980 | Schwappach | 37/457 |
| 4,282,665 | 8/1981 | Fletcher et al. | 37/457 |
| 4,357,765 | 11/1982 | Seykora | 37/455 |
| 4,433,496 | 2/1984 | Jones et al. | 37/456 |
| 5,063,696 | 11/1991 | Smith | 37/455 |
| 5,134,793 | 8/1992 | Bierwith | 37/458 |
| 5,152,088 | 10/1992 | Hahn | 37/458 |
| 5,311,681 | 5/1994 | Ruvane et al. | 37/452 X |
| 5,452,529 | 9/1995 | Neuenfeldt et al. | 37/455 |

FOREIGN PATENT DOCUMENTS

| | | | |
|---|---|---|---|
| 2022881 | 12/1971 | Germany | 37/458 |

*Primary Examiner*—Terry Lee Melius
*Assistant Examiner*—Thomas A. Beach
*Attorney, Agent, or Firm*—Bauer & Schaffer

[57] ABSTRACT

Retaining pin assemblies for use in releasably securing an excavating tooth or point to a mounting adaptor. Each pin assembly includes one or more holders insertable lengthwise in registering apertures in the adaptor and tooth and movable thereafter widthwise to cause interengagement. The holder and the apertures are provided with complementary portions. A locking member is inserted after engagement of the pin to fix the adaptor and tooth together.

11 Claims, 4 Drawing Sheets

EXCAVATOR TOOTH RETAINING ASSEMBLY

TECHNICAL FIELD

THIS INVENTION relates to improvements in and relating to excavator tooth retaining assemblies.

BACKGROUND ART

More particularly, the invention has reference to novel retaining pin constructions and arrangements for use in releasably securing an excavating tooth or point or tip (hereinafter for convenience called "a ground-engaging tooth point member") to its mounting adaptor. The latter is conventionally of the type having a forwardly disposed nose portion and a rearwardly dispose base portion, and the tooth point member has a socket or pocket formed in its rear section for receiving said nose portion of the adaptor.

Such arrangements are usable in various applications, the most common being a loading bucket as used by draglines, front end loaders, tracked earth moving machines and the like. The ground engagement of the tooth point members causes them to become worn and thus ineffective over a period so that they require to be replaced. Thus, the nature, type, disposition and accessibility of the retaining pins used for securing the tooth point members to their adaptors can be most important relative to achieving desirable removability, while being efficient in all operational aspects.

Over many years there has been considerable development and improvements in the art of connecting tooth point members to adaptors by suitable retaining pin means. It is currently sought to provide a retaining pin which may be easily fitted in its operative position, will remain there during normal operations until such time as the ground-engaging tooth point member requires replacement, and then will be easily removed. For many years such a standard type of retaining pin has been inserted through registering apertures extending respectively through the tooth point member and adaptor and forcibly hit with a hammer until caused to be deformed and thereby retain the tooth point member by an interference fit. Removal of the deformed pin is then achieved by again hitting it with a hammer to force it out of the apertures a procedure which may be very difficult and time consuming. Alternatively the retaining pin may fall from the apertures unintentionaly during operation when operational forces may act on the pin in the direction of pin removal and force it out.

U.S. Pat. No. 4,326,348 of Esco Corporation and Australian Patent No. 620074 of Caterpillar Inc. show pin fastening assemblies which overcome the problem of pins inadvertently falling out of their apertures during operation by having the pins disposed horizontally. This method, however has largely been rejected by the industry due to the difficulty in accessing the apertures from the sides of the tooth point members as the tooth point members are disposed in a side by side configuration with insufficient working space therebetween.

Current vertically disposed retaining pins including that of Australian Patent No. 617545 of Esas Corporation require a separate elastic or spring retainer to maintain each pin in its retaining position. In this example the pin is maintained in position by compressing an elastic component to generate interference when fitted. Due to the work carried out by the tooth point members in operation, movement causes frictional heat to which the elastic material is subjected leading to its degradation and subsequent reduced maintaining ability whereby the pin may fall out of its retaining position.

Notwithstanding the prior art as aforementioned, I have considered there remains a need for substantial improvements in locking pin arrangements for such tooth point members, particularly to overcome present disadvantages arising from the manner in which the parts currently lock together and are difficult to access and to remove, as well as current tendencies for the pins to be insecure or to fall out. Thus, my invention aims to provide a novel form of retaining pin means which may be simply used to achieve efficiency in those aspects in which previous constructions have been found wanting. In particular, the invention aims to provide an improved retaining pin means which will allow quick replacement of tooth point members when necessary but which will remain firmly in retaining disposition between replacement times.

It is a further object of the invention to provide a retaining pin that does not require any form of deformation or compression to remain in its retaining position and does not undergo degradation during use so that it may be used more than once.

DISCLOSURE OF THE INVENTION

With the foregoing and other objects in view, the invention resides broadly in an excavating tooth assembly of the type having:

an adaptor provided with a forwardly disposed nose portion and a rearwardly disposed base portion;

a ground-engaging tooth point member having a socket formed in its rear section for receiving said nose portion of said adaptor, and pin means extending through and releasably intersecuring said tooth point member and said nose portion of said adaptor, said pin means being passed through apertures in opposed spaced walls of the tooth point member defining said socket and through registering aperture means of the nose portion when the latter is received in said tooth point member;

characterized in that said pin means comprises pin members including (1) one or more elongate holding members adapted to be inserted lengthwise in entry attitude and then to be moved widthwise to cause engagement means on the or each holding member to engage complimentary portions of the aperture surrounds and assume operative attitude, and (2) a locking member adapted to be inserted after the or each holding member has been moved widthwise and adapted to lock said holding member or members in operative attitude.

It is preferred that said pin members assume a parallel layered formation when they are in their operative attitudes and are so made and arranged as to coact and be retained firmly but removably while rigidifying and maintaining the combined effective width of the pin members in their operative attitudes. It is also preferred that said engagement means on the or each elongate holding member includes a shoulder at each end adapted to receive therebetween a wall portion at said aperture means of said nose portion, said shoulders acting to permit the aforementioned widthwise movement of the or each holding member.

In one preferred embodiment of the invention said pin means has a single holding member and the locking member is insertable when said holding member is in its operative attitude and retained firmly but removably between said holding member and a wall portion of said nose portion. It is further preferred that the locking member and holding member in layered formation have their direction through the layers disposed parallel to the direction in which the nose portion and tooth point member extend in operation.

In another embodiment of the invention the pin means comprises three elongate pin members including two holding members and a locking member in parallel sandwich-layer formation when operative and each extending through or within the apertures in the direction between said opposed spaced walls, and wherein:

the first holding member is freely insertable lengthwise in entry attitude and then movable widthwise to cause said engagement means thereon to engage said complimentary portions of the aperture surrounds and assume operative attitude;

the second holding member is insertable lengthwise in entry attitude when the first holding member is in operative attitude and is then movable widthwise to operative attitude in the direction away from said first holding member to leave a space therebetween and with the second holding member also having said engagement means engaging said complimentary portions of the aperture surrounds opposed to the portions engaged by the first holding member; and the parts of the pin means are so made and arranged that said locking member may be inserted lengthwise and retained firmly but removably between the first and second holding members to rigidify and maintain the combined effective width of the sandwich-layer pin means in the direction through the layers provided by the three pin members in their operative attitudes.

It is further preferred that the three pin members in layered formation have their direction through the layers disposed transversely in relation to the direction in which the nose portion and tooth point member extend in operation.

In order that the invention may be understood and put into practical effect, reference will now be made to the accompanying drawings, wherein:

BEST METHOD OF CARRYING OUT THE INVENTION

Figure 2:
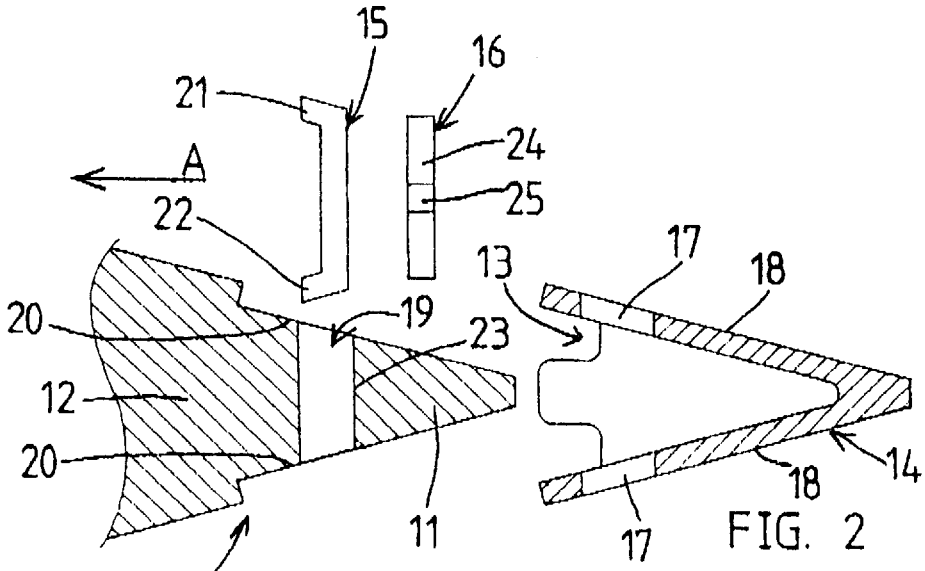
FIG. 2 shows in cross-section from the side the same features of FIG. 1 shown in separated relationship.

3 shows in cross-section from the side the same features of FIG. 2 with the tooth point member receiving the adapter and having the holding member in its operative disposition and the locking member in party separated relationship.

Figure 1:
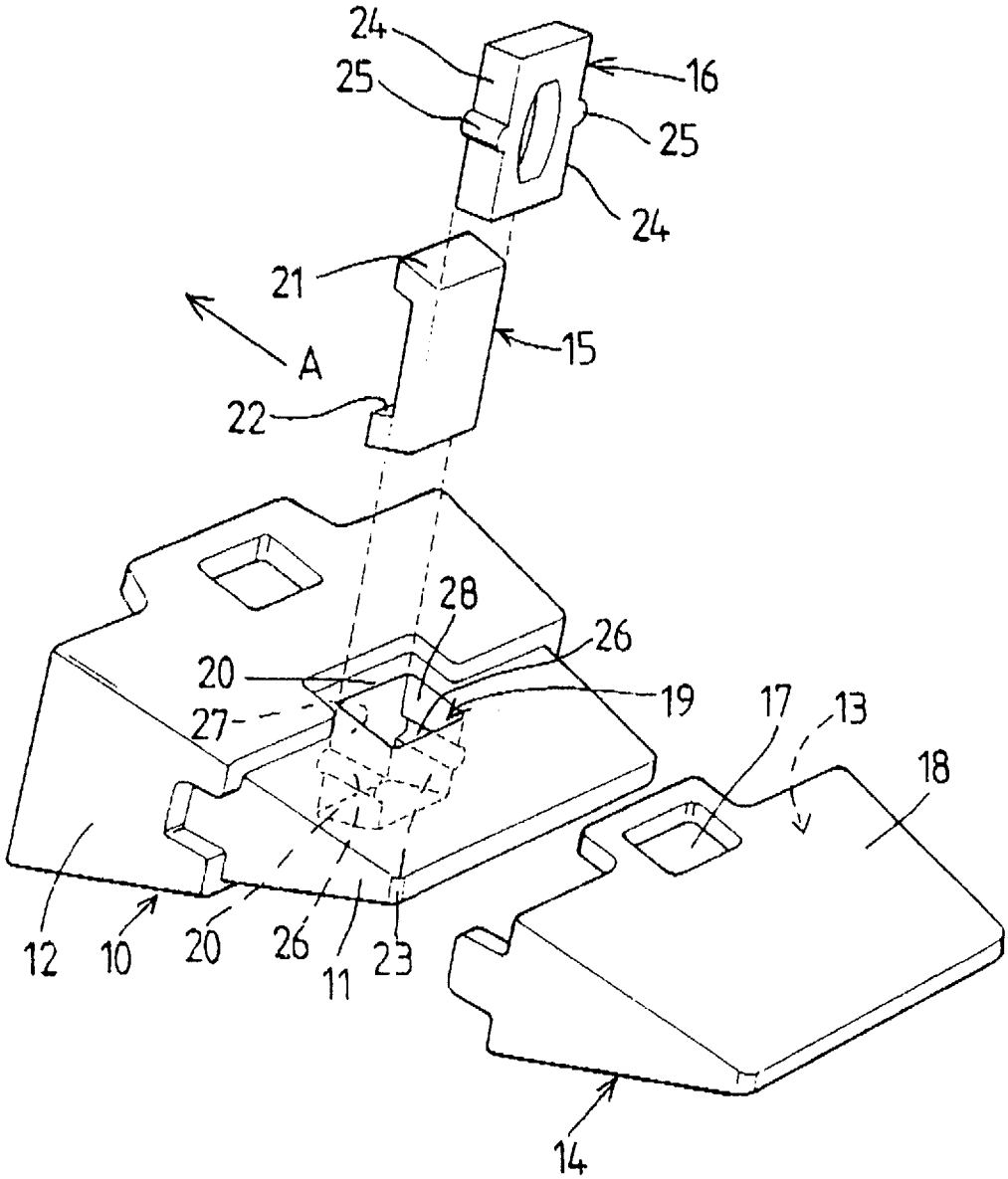
FIG. 1 shows in perspective view a typical example of a tooth point member and an adaptor which are to be intersecured but are illustrated in separated relationship and the two pin portions constituting one preferred embodiment of the novel pin means according to the invention also shown in separated relationship.
Figure 3:
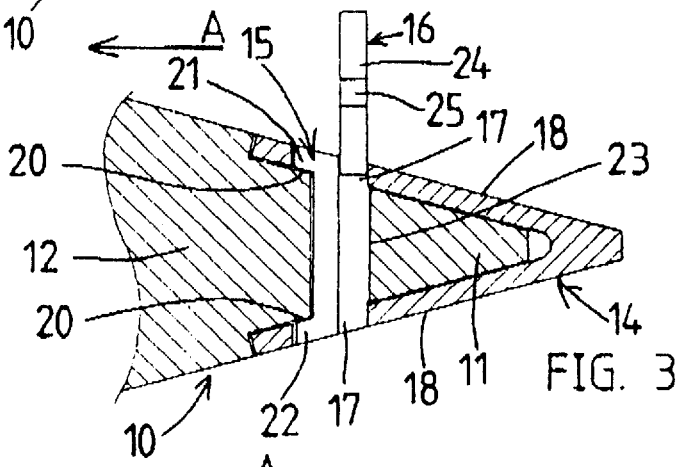
Figure 4:
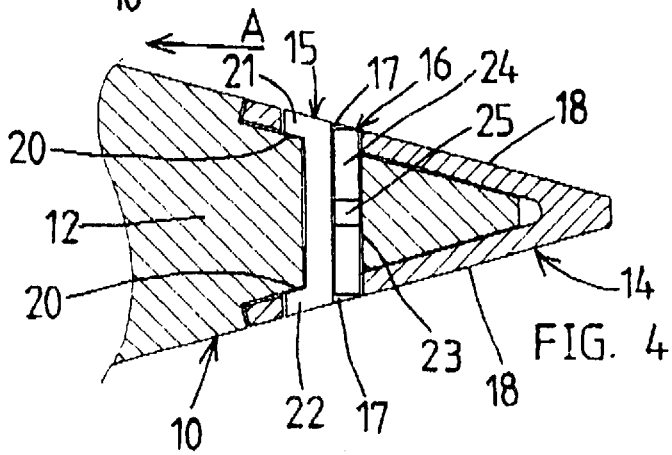
Figure 5:
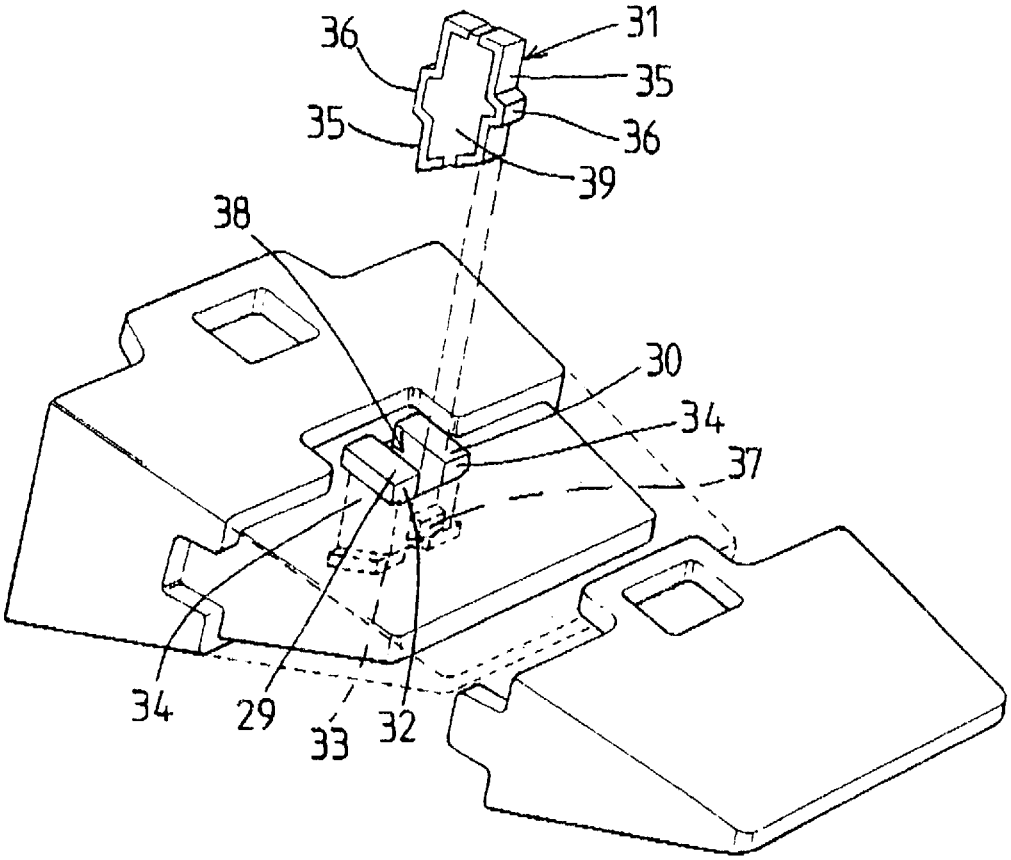
Figure 6:
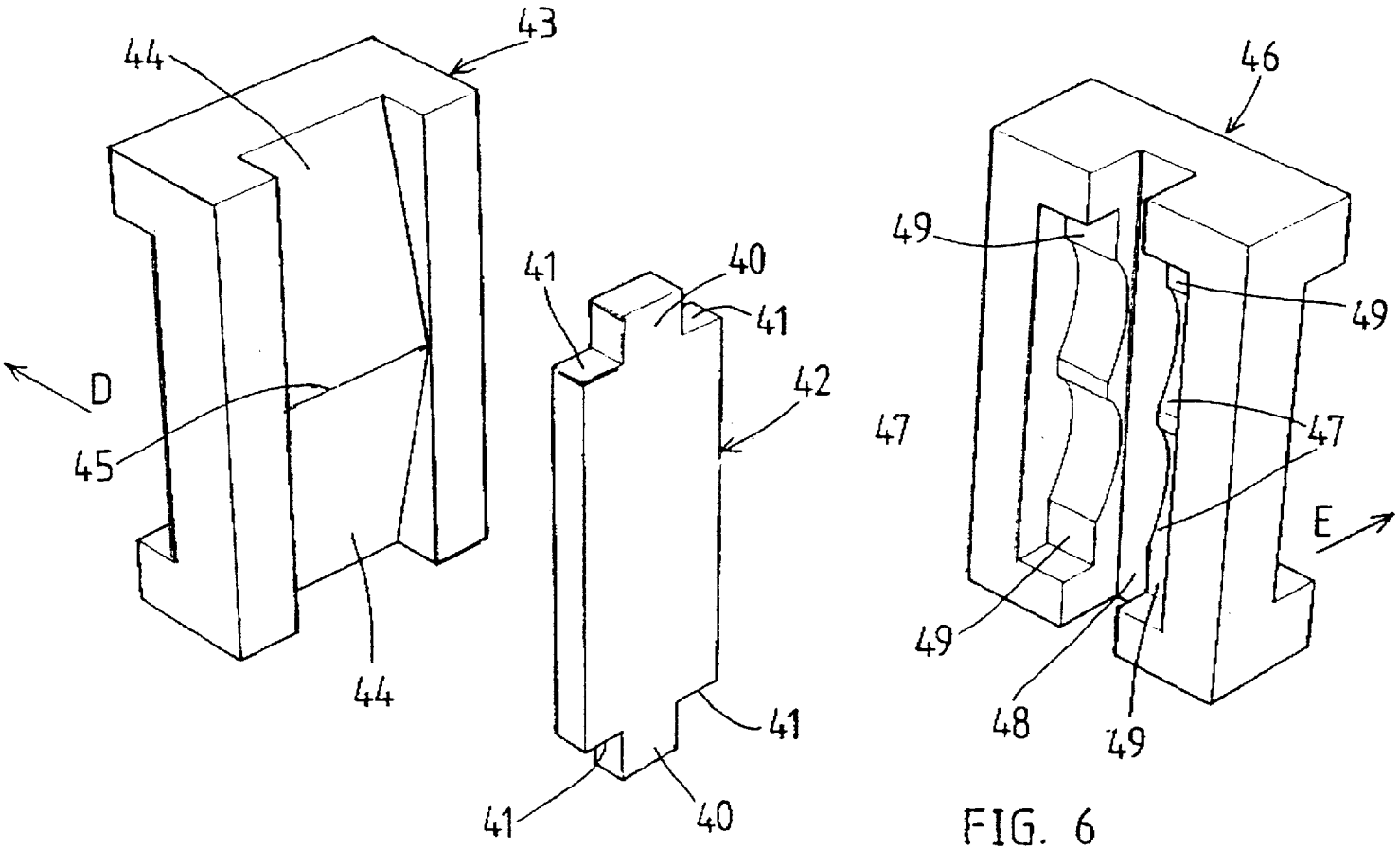

FIG. 4 shows in cross-section from the side the same features of FIGS. 2 and 3 with the two pin members in their operative dispositions;

FIG. 5 shows in perspective view a tooth point member and adaptor in similar relationship to FIG. 1 but showing an alternative embodiment of the novel pin means according to the invention; and FIG. 6 shows in perspective view and in separated relationship an alternative arrangement of the pin means.

Referring initially to FIGS. 1 to 4 of the drawings, a standard type of adaptor 10 has a tapered forwardly disposed nose portion 11 and a rearwardly disposed base portion 12 for connection operatively to the excavating implement. The nose portion 11 is adapted to fit closely and wedgedly into a rear socket 13 of the ground-engaging tooth point member 14. To receive the pin means, which includes holding member 15 and locking member 16, the tooth point member 14 has apertures comprising upper and lower aperture openings 17 of rectangular shape through opposed side walls defining the socket 13, while the nose portion 11 has a registering through-aperture 18 of rectangular form. When the nose portion 11 is in the point member 14 (shown in FIGS. 3 and 4) all said apertures 17 and 19 will be continuous as a rectangular opening of uniform cross-section through its vertical depth which is the direction in which the pin means will be inserted. It will be apparent that the ends of the aperture 19 include side edges 20, and these are engaged in the assembled attitude by shoulders of the holding member 15 as later described.

The holding member and locking member 16 are of elongate form and are adapted to be arranged in parallel layer formation when operative so that each extends vertically in the direction between the opposed spaced walls at the aperture openings 17.

It will be apparent that the holding member 15 can be freely inserted lengthwise into the opening defined by the apertures 17 and 19 and can then be moved widthwise in the direction of arrow A so that upper and lower external shoulders 22 and 23 engage the side edges 20 of the opening at the aperture surrounds and the holding member 15 assumes its operative attitude (shown in FIGS. 2 and 3).

The locking member 16 is flat having a thickness almost equal to the distance between the holding member 15 and a side wall 23 of the aperture 19 when the former is in its operative position, thus allowing insertion of the locking member 16 therebetween. The locking member 16 has resilient spaced part 24 sides including side lugs 25 disposed thereon and engageable by locking apertures 26 provided within the aperture 19. The locking member 16 has a width almost equal to the distance between the two side walls 27 and 28 (shown in FIG. 1) of operative 19 where side lugs 25 extend beyond said width. The side lugs 25 urge spaced apart sides 24 towards each other to allow insertion of the locking member 16 whereby the side lugs 25 slide adjacent the walls of the aperture 19 until side lugs 25 engage locking apertures 26 where the locking member 16 is maintained firmly but removably. The pin means is now locked in aperture 19 wherein the combined effective width of the two pin members lock the holding member 15 in its operative position, (shown in FIG. 4) this being held in the direction of arrow A.

An alternative embodiment of the invention is shown in FIG. 5 wherein the novel pin means consists of three members, namely a first holding member 29, a second holding member 30 and a locking member 31. These are all of elongate form and are adapted to be arranged in parallel sandwich-layer formation when operative so that each extends vertically in the direction between the opposed spaced walls at the aperture openings. The first and second holding members 29 and 30 extend from each side of the opening, while the holding member 31 is within the aperture means but not as long as the others.

It will be apparent that the first holding member 29 can be freely inserted lengthwise into the opening defined by the aperture means and can then be moved widthwise so that the shoulders 32 and 33 engage the side edges 34 of the opening at the aperture surrounds and the holding member 29 assumes its operative attitude. The second holding member 30 can then be inserted lengthwise once the first holding member 29 is in position to allow it to pass comfortably, whereafter the second holding member 30 is also movable widthwise to operative position opposite the first holding member 29 and thus leaving a space therebetween, the second holding member 30 also engaging the aperture surround and edge 34 but at the opposite side to the first holding member 29.

It will be seen that the maintaining portion 31 is similar in construction to that shown in FIGS. 1 to 4 including solid side portions 35 having side lugs 36 disposed thereon and engageable by locking apertures 37 provided within the aperture 38. In this case the side lugs 36 are urged into locking apertures 37 by a resilient rubber filler block 39. Other types of bias means could be used if so desired, but this embodiment illustrates the many additional variations which may be introduced if so desired.

An alternative type of pin means shown in FIG. 6 includes first and second retainer portions insertable in a similar way to the previously by described embodiment.

In this case, the locking member 42 is a flat plate with end tabs 40 having shoulders 41 at each side, and this has a thickness almost equal to the distance between the first and second holding members when the latter are in operative positions, thus allowing insertion of the locking member 42 therebetween. To facilitate this, the first holding member 43 has upper and lower ramps 44 as illustrated on either side of a hinge shoulder 45 so that the holding member or plate 42 may be inserted lengthwise and retained firmly but removably to rigidify and maintain the combined effective width of the three pin members in the direction through the layers, this being the direction of arrows D and E.

The second holding member 46 has upper and lower arcuate grooves and receiving slots 47 so that the inserted end of the locking member 42 can enter and permit a skew disposition in passing the hinge shoulder 45, whereafter the locking member 42 can be brought to a disposition parallel to the other two and will lock into position by the tabs 40 being within the medial vertical groove 48 of the second holding member and the shoulders 41 held on locating surfaces 49 of the second holding member 46. The groove 48 ensures that the locking member 42 can be removed when it becomes necessary to change the point member, but this involves a positive "seek and remove" action so that accidental release at normal times cannot occur.

While the illustrated embodiments will be found very effective in achieving the objects from which the invention has been devised this specification is directed to persons skilled in the art who will appreciate that very many further modifications of constructional detail and design may be made, without departing from the broad scope and ambit of the invention, the general nature of which has been set forth herein.

I claim:

1. A demountable excavator tooth assembly comprising a base member having a coupling portion, and a tooth member having a coupling portion complementary to that of the base member, each of said coupling portions having an aperture which is in register with the other when said base and tooth members are assembled, a holding member having a length and width having coupling portions engageable with complementary portions of the assembled base and tooth members and a locking member, and wherein the holding member is insertable lengthwise in entry attitude through said registering apertures and then movable widthwise to cause said holding member to seat the complementary portions of the assembled base and tooth members and assume operative attitude, and a locking member slidably insertable in the registering apertures, said holding member and said locking member each having parallel surfaces adapted to engage each other and said base member, whereby all of said surfaces are parallel to each other and remain parallel with respect to each other to maintain the holding member seated on the complementary portions of the assembled base and tooth members preventing lengthwise withdrawal movement of the holding member.

2. An assembly as claimed in claim 1, wherein the coupling portion of the holding member has a female formation which engages a complementary male formation of the base member.

3. An assembly as claimed in claim 2, wherein said complementary male formation of the base member is part of the coupling portion of the base member.

4. An assembly as claimed in claim 3, wherein the female formation of the holding member has spaced protrusions which abut mutually oppositely facing surfaces of the base member.

5. An assembly as claimed in claim 4, wherein the said protrusions protrude from the holding member transversely of the registering apertures.

6. An assembly as claimed in claim 1, further comprising detent means effective to hold the locking member in said position within the registering apertures adjacent the holding member.

7. An assembly as claimed in claim 6, wherein the detent means comprises a resiliently deformable detent portion of said locking member engageable with a detent hollow in a wall of said aligned apertures when the locking member is in its said position within the registering apertures.

8. An assembly as claimed in claim 7, wherein the holding member abuts one side of the aligned apertures and the locking member fits snugly between the holding member and the opposite side of the aligned apertures.

9. An assembly as claimed in claim 1, including a pair of holding members each having a coupling portion engaged with the assembled base and tooth members so as to prevent withdrawal movements of those holding members and held spaced apart within aligned apertures by the locking member.

10. An assembly as claimed in claim 9, wherein the locking member fits snugly between the pair of holding members.

11. An assembly as claimed in claim 10, wherein the locking member in its operative position fits within a groove in one of the holding members so as to be constrained against withdrawal but which can be moved to a skewed position relative to the holding members in which it can be withdrawn from its position between those two members.

* * * * *